US005826343A

United States Patent [19]

Mollberg, Jr.

[11] Patent Number: 5,826,343

[45] Date of Patent: Oct. 27, 1998

[54] CHAIN SAW ATTACHMENT

[75] Inventor: Russell E. Mollberg, Jr., Palm Beach Gardens, Fla.

[73] Assignee: Kinetic Stump Cutter, Inc., Palm Beach Gardens, Fla.

[21] Appl. No.: 735,219

[22] Filed: Oct. 22, 1996

[51] Int. Cl.[6] ..... B27B 17/02

[52] U.S. Cl. ..... 30/371; 30/382; 83/745

[58] Field of Search ..... 30/371, 372, 378, 30/382; 83/745

[56] References Cited

U.S. PATENT DOCUMENTS

| | | | |
|---|---|---|---|
| 359,042 | 3/1887 | Van Winkle | 30/372 |
| 2,446,774 | 8/1948 | Mall | 30/371 |
| 2,636,524 | 4/1953 | Leckington | 30/372 |
| 2,665,719 | 1/1954 | Pennanen | 30/371 |
| 2,813,556 | 11/1957 | Woodworth | 30/371 |
| 2,821,213 | 1/1958 | York | 30/371 |
| 4,569,135 | 2/1986 | Morabit | 30/371 |

*Primary Examiner*—Hwei-Siu Payer
*Attorney, Agent, or Firm*—John Lezdey

[57] ABSTRACT

The present invention provides an improved power driven chain saw that includes a device for controlling and eliminating kickback reactive forces. The anti-kickback control device includes a free swinging pivotable attachment that has a distal end portion which is shaped-like a spike or a hook and a proximal end portion which extends longitudinally. The distal end portion is positioned at an angle to the proximal end portion and the spike or hook is used to hold an object to be cut. The proximal end portion is mounted on a pivot member and this assembly is then mounted on the chain saw. The gaff member attachment is designed such that it can engage an object to be cut at an angle and remain therein while an operator pivots the chain saw during a cutting operation.

10 Claims, 2 Drawing Sheets

CHAIN SAW ATTACHMENT

BACKGROUND OF THE INVENTION

1. Field of the Invention

The present invention relates to an attachment for a chain saw and more particularly to a chain saw attachment for preventing kickback when the user cuts a tree log, limb or other similar object.

2. Description of the Prior Art

Power driven chain saws are very dangerous to use particularly for an inexperienced user such as the homeowner who cuts firewood. The user of a bar type chain saw will often hold the saw either too close or too far from the wood being cut. Sometimes the user cuts the wood in an unsafe position because he wants to avoid setting the saw down and moving himself or the workpiece to a safer and better position for cutting. Today, there are many more new users. With the advent of new materials which are lighter and stronger than steel housings, new chain saw designs today are correspondingly lighter and easier to use.

A major concern in the design of chain saws are safety precautions to minimize the risk of kickback. As will be explained in more detail below, kickback may occur when the nose or tip of the guide bar touches an object or when the wood closes in and pinches the saw chain in the cut. In addition, tip contact in some cases may cause a lightning fast reverse reaction, kicking the guide bar up and back towards the operator. Thus reaction may cause the operator to lose control of the saw which could result in serious personal injury.

Section 5.12 of ANSI B 175.1-1991 (Voluntary Standard Safety Requirements for Gasoline-Powered Chain-Saws) sets certain performance and design criteria related to chain saw kickback. Of course, the most important safety precaution that can be taken is the knowledge of the operator who can greatly minimize the element of surprise and minimize the chance of a serious accident. However, the novice, or even the experienced operator, needs some further protection to help minimize the risk of kickback. Therefore, chain saw manufacturers are constantly trying to design new feature to reduce the occurrence of kickback.

The powerful forces used to cut wood can be reversed and work against the operator. If the rotating chain is suddenly stopped by contact with any solid object like a log or branch, or is pinched, or strikes a foreign object such as rocks, nails, etc., the reactive forces may occur instantly. The guide bar and chain can pop out of the kerf cut with an upwards reactive force and sometimes shift toward the operator in an uncontrolled arc. These reactive forces may result in loss of control which may, in turn, cause serious or fatal injury.

Kickback may occur when the upper quadrant of the bar nose contacts a solid object or is pinched. The reaction of the cutting force of the chain causes a rotational force on the chain saw in the direction opposite to the chain movement. This may fling the bar up and back in an uncontrolled arc mainly in the plane of the bar. Under some cutting circumstances, the bar can move towards the operator, risking severe or fatal injury. Kickback may also occur when the nose of the guide bar is pinched unexpectedly or unintentionally contacts solid material in the wood or is incorrectly used to begin a plunge or boring cut. It may also occur during limbing.

The greater the force of the kickback reaction, the more difficult it becomes for the operator to control the saw. Many factors influence the occurrence and force of the kickback reaction. These include chain speed, the speed at which the bar and chain contact the object, the angle of contact, the condition of the chain and other factors. The type of bar and chain saw that is used is another important factor in the occurrence and force of the kickback reaction. Some bar and chain types are designed to reduce kickback forces.

As mentioned above, Section 5.12 of ANSI standard B 175.1-1991 sets certain performance and design criteria related to chain saw kickback. To comply with Section 5.12 of ANSI B 175.1-1991:

a) saws with a displacement of less than 3.8 cubic inches must, in their original condition, meet a 45° computer derived kickback angle when equipped with certain cutting attachments;

and must be equipped with at least two devices to reduce the risk of kickback injury, such as a chain brake, low kickback chain, reduced kickback bar, etc.

b) saws with a displacement of 3.8 cubic inches and above must be equipped with at least one device designed to reduce the risk of kickback injury such as a chain brake, low kickback chain, reduced kickback bar, etc.

These kickback requirements do not apply to chain saws fitted with bow guides.

The computer derived angles for saws below 3.8 cubic inch displacement are measured by applying a computer program to test results from a kickback test machine. However, the computer derived angles of Section 5.12 of ANSI B 175.1-1991 may not bear a relationship to actual kickback bar rotation angles that may occur in real life cutting situations. Compliance with Section 5.12 of ANSI B 175.1-1991 does not automatically mean that in a real life occurrence of kickback, the bar and chain will rotate no more than 45°.

Manufacturers have supplied a variety of bars, chains and brakes which can reduce the risk of kickback. For example, various "low kickback chains" and "reduced kickback bars" have been developed. A "low kickback chain" is a chain which has met the kickback performance requirements of Section 5.12.2.4 of ANSI B 175.1-1991 when tested on a selected representative sample of chain saws below 3.8 cubic inch displacement specified in ASNI B 175.1-1991. A low kickback chain usually reduces the width or kerf of the cutters, raises the connector links between the cutters and lengthens and widens the rakers on the cutters. Moreover, "reduced kickback bars" are also used often in combination with the low kickback chains. The reduced kickback bar is a guide bar having reduced or narrowed radii at the bar tip so that less surface area is exposed. These bar/chain combinations are rigorously tested and approved for use to minimize the risk of kickback. This is because use of other, non-approved bar/chain combinations may increase kickback forces and correspondingly, increase the risk of kickback injury.

Furthermore, another common safety device used in combination with the low kickback chains and reduced kickback bars is the use of a chain brake on the powerhead. A chain brake is available as standard equipment on many chain saws. The chain brake is designed to stop the chain saw in fractions of a second.

However, no chain brake device prevents kickback. These devices are designed to reduce the risk of kickback injury, if activated, in certain kickback situations. A major problem is that the chain brake is designed to work after the kickback has occurred.

Similarly, the reduced kickback bars do not prevent kickback. In fact, when used with other more aggressive chains, these bars may be less effective in reducing kickback and may result in higher kickback forces. Likewise, the low kickback chains do not prevent kickback. A dull or improperly sharpened chain may reduce or negate the effects of the design features intended to reduce kickback energy. Improper lowering or sharpening of the depth gauges or shaping of the cutters may increase the chance and the potential energy of a kickback.

Another device which is seldomly used to reduce kickback are tip guards. A tip guard is a wide guard mounted at the end or tip of the guide bar. However, this guard puts a limit on the work to be done because the operator cannot cut an object larger than the length of the bar cutting area since the bar cannot pass through the kerf. Furthermore, other safety devices and designs which were developed, including bumper spikes, adjustments to raker heights and varying dimensions of chain connector links and sprockets, also do not prevent kickback. Thus, reduced kickback bars, low kickback chains, chain brakes and other similar type of devices are designed to reduce the risk of kickback injury, but do not prevent kickback occurrences.

Representative of the prior art are two patents, U.S. Pat. Nos. 2,813,556 and 4,534,111. U.S. Pat. No. 2,813,556 to Woodworth, which is herewith incorporated by reference, teaches a chain saw which minimizes kickback. The Woodworth chain saw includes a spiked reaction attachment for holding the log and for preventing the distal end of the bar and chain from engaging the ground while the proximal end of the bar and chain can be guided through the log. The Woodworth spiked attachment is secured to the chain saw guide bar with multiple bolts. This spiked attachment, however, pulls itself out during rotation of the chain and bar and regrabs the log several times before the cutting is complete. Therefore, this spiked attachment does not prevent kickback that can occur during the cutting operation.

U.S. Pat. No. 4,534,111 to Eistrat, which is herewith incorporated by reference, discloses a positioning tool for safely moving wood before cutting and for reducing kickback. The Eistrat positioning tool has multiple pointed hooks and points and extends beyond the end of the chain saw guide bar. This positioning tool, however, also pulls out during rotation of the chain and bar and thus regrabs the wood several times before cutting is complete. Therefore, like the spiked attachment is Woodworth, the Eistrat positioning tool does not prevent kickback that can occur during the cutting operation.

The conventional chain saw today leaves much to be desired in preventing and protecting against kickback. Accordingly, there is a need in the industry to provide more efficient devices for minimizing the risk of kickback in chain saws. Furthermore, there is a need to provide an anti-kickback device which does not fall out, is easy to control and can adapt to different sized diameters of wood. The primary object of this invention is to provide such a type of device and to overcome all other prior art limitations and disadvantages.

In light of this need, it is an object of this invention to provide an improved chain saw having means for controlling the kickback reactive forces that can occur during a cutting operation.

It is a further object of this invention to provide an improved chain saw having means for preventing kickback before it begins.

It is yet another object of this invention to provide an attachment to a chain saw which controls and prevents kickback.

It is yet a further object of this invention to provide an anti-kickback attachment which is light, strong, adjustable, compact, durable, safe, economical and easy to use.

SUMMARY OF THE INVENTION

The present invention teaches an improved power driven chain saw having means for controlling and preventing kickback via a gaff attachment. The chain saw includes a motor which is mounted inside of a housing, a guide bar having a substantially equal lower and upper end saw chain, a rail groove which extends circumferentially around the guide bar and a saw chain which sits within the rail groove. The gaff attachment supplies the means for controlling kickback during the operation of cutting. The gaff has a distal end portion and a proximal end portion. The distal end portion is in a form of a spike or a hook which can penetrate and engage an object to be cut. The distal end portion is located at an angle to the proximal end portion. The proximal end portion is longitudinally extended and is mounted on a free swinging pivot member that is mounted offset on the guide bar of the chain saw. The housing acts as a stop member when the gaff is engaging the object to be cut. During a cutting operation, the gaff can engage an object to be cut at an angle and remain therein while the operator pivots the housing and the guide bar. The design is such that the gaff attachment becomes a fulcrum point during the cutting operation.

In other embodiments of the invention, the gaff attachment is slidable along the guide bar and the spacing between the gaff and the housing is adjustable. The combination provided by the present invention facilitates the use of a chain saw without a risk of kickback by drastically reducing and even eliminating the chances of a kickback occurrence. The advantages and objects of the present invention will become more evident by referring to the following description and claims taken in conjunction with the accompanying drawings.

DESCRIPTION OF THE PREFERRED EMBODIMENTS

The object of this invention is not to delete or replace any existing methods which help minimize the risk of bodily harm to a chain saw operator, but rather, it is the intention of the present invention to design an improved power driven chain saw with means for controlling kickback wherein said means can operate alone or in conjunction with other safety methods such as those discussed hereinbefore. In particular, the anti-kickback control means includes a gaff attachment for the chain saw. The gaff does not interfere with other safety devices and features. Once engaged, the gaff is an automatic device as there are no buttons to push or levers to pull. The gaff works on all sized objects to be cut and once engaged continues to work for the duration of the cutting operation. It is the only device known which can prevent the reactive force of kickback.

Figure 1:
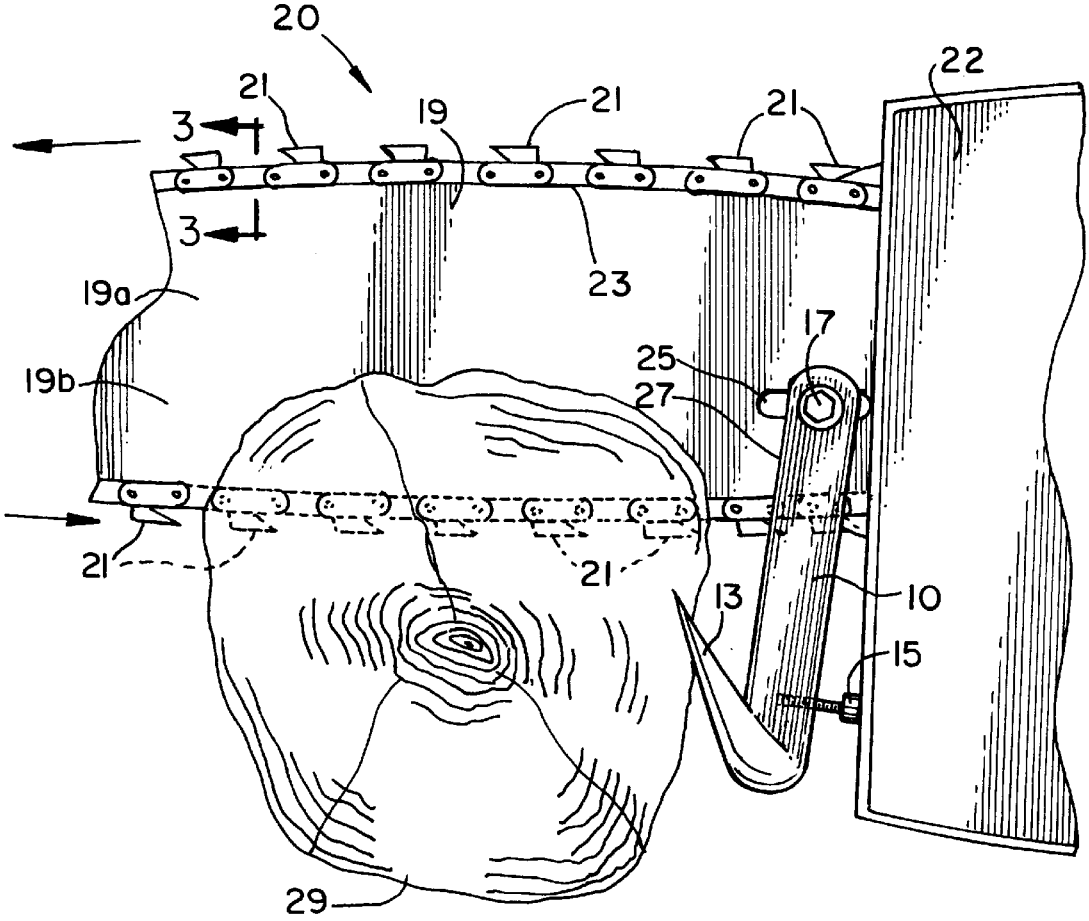
FIG. 1 is a side elevation of the gaff attachment and a cut out portion of the power driven chain saw.

Referring now to the drawings, FIG. 1 shows a gaff attachment 10 mounted to a power driven chain saw 20. The gaff 10 provides means for controlling kickback during a cutting operation. The chain saw 20 includes a housing 22 and a motor (not shown) mounted therein. The chain saw 20 further includes a guide bar 19 having a lower end 19*b* and an upper end 19*a* and a rail groove 23 which extends circumferentially around the guide bar 19. A cutting linked chain 21 is also shown and sits within the rail groove 23.

The gaff 10 includes a distal end portion 13 and a proximal end portion 27. The distal end portion 13 is shaped like a spike or a hook such that it can easily penetrate and engage an object 29 to be cut such as a log, a limb, a piece of wood and the like. The proximal end portion 27 extends longitudinally or perpendicularly and has means for pivotally mounting it on the guide bar 19 of the chain saw 20. Preferably, the pivot means includes the proximal end portion 27 having a hole (not shown) for accepting a pivot member 17 on which the gaff is mounted. The combination gaff 10 and pivot member 17 is then mounted on the guide bar 19 of the chain saw 20. Advantageously, the pivot member 17 can be an arm, wheel bearing, bushing or the like.

The essence of the present invention can now be seen. The engagement of the gaff 10 entry into the object 29 to be cut is determined by the diameter of the object after the guide bar 19 and chain 21 make the initial kerf cut. During the cutting operation, the gaff assembly 10 remains engaged with the object 29 to be cut as the housing 22 and guide bar 19 are pivoted. The pivot point of the gaff assembly 10 becomes a fulcrum point during the cutting operation provides a smooth and even cutting operation.

Preferably, the combination gaff 10 and pivot member 17 are mounted on guide bar 19 of the chain saw 20 through an aperture 25. The aperture 25 is advantageously positioned near a lower end 19*b* of the guide bar 19. It is most preferable to elongate the aperture 25. Having an elongated aperture 25 for accepting the combination gaff 10 and pivot member 17, the gaff becomes slidable along the aperture 25 and the pivot member 17 is positionable near the housing 22 when the chain saw is at a rest or non-working position. The elongated hole permits adjustment of the saw chain.

Advantageously, means for adjusting a spacing between the gaff 10 and the housing 22 is also included. For example, one embodiment of the present invention employs a set screw 15 mounted on the proximal end portion 27 of the gaff 10. The set screw 15 can move in and out and makes the gaff 10 adaptable to fit on a wide variety of chain saws regardless of the shape of the housing 22 or guide bar 19.

Figure 2:
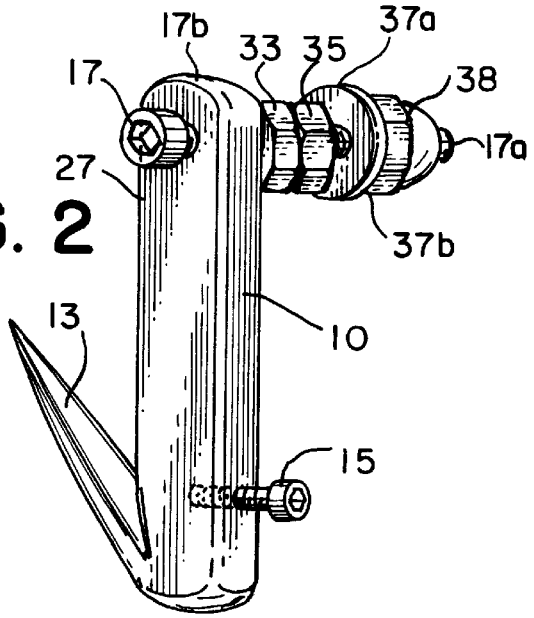
FIG. 2 is a cut out portion of the chain saw's guide bar rail groove.

FIG. 2 shows a cut out portion of the guide bar 19 and the chain drive links 21 which are housed in the rail groove 23.

Figure 3:
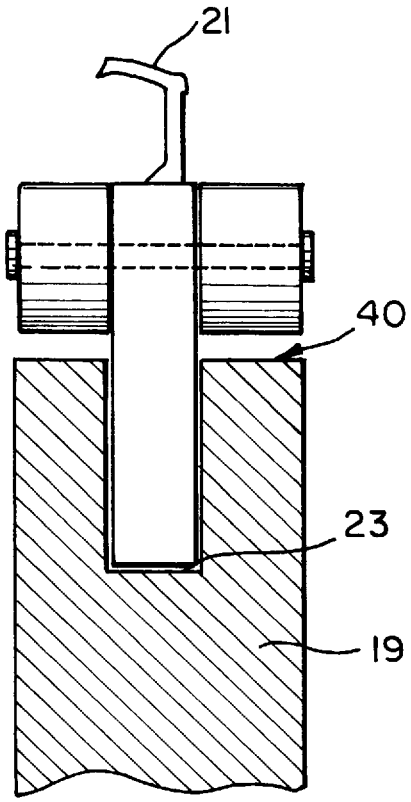
FIG. 3 is an exploded view of the gaff attachment.

FIG. 3 illustrates an exploded view of the combination gaff 10 and pivot member 17. The distal end portion 13 of the gaff 10 is positioned at an angle to the proximal end portion 27. Preferably, the angle between the distal 13 and proximal 27 end portions is an acute angle. Most preferably, the acute angle is about 30°. It has been found unexpectedly that when the gaff 10 enters the object 29 to be cut at an angle of 30°, it provides superior performance of the anti-kickback gaff attachment 10, while maintaining the guide bar 19 and chain 21 in a kerf cut. The set screw 15 is also very effective in maintaining the 30° angle for irregularly shaped housings.

The pivot member 17 preferably includes an end 17*a* and an end 17*b*. The end 17*a* of the pivot member 17 is preferably attached to the lower end 19*b* of the guide bar 19 through the aperture 25. The gaff 10 is advantageously positioned above the rail groove 23 on an inward and frontal side of the housing 22. In this embodiment, the gaff 10 is preferably mounted at an angle to the pivot member 17 such that the distal end portion 13 of the gaff 10 faces forward and upward at end 17*b* of the pivot arm 17.

The gaff attachment 10 is adjustable and adaptable to fit a wide variety of chain saws 20. The present invention holds the object 29 to be cut from the underside on the cant angle of the object 29 such as a log. The swivel feature of the combination gaff 10 and pivot member 17 ensures that the gaff 10 will not get in the way of the cutting operation. Furthermore, this embodiment includes means for spacing the combination gaff 10 and pivot member 17 from the guide bar 19. This design provides good clearance between the gaff 10 and the guide bar 19 and chain 21. This clearance importantly allows for normal chain stretch from heat, lack of oil, etc., such that the gaff 10 will never interfere with the cutting operation if the chain sags on the guide bar 19.

The distance between the point of portion 13 and the outer most edge 40 (bottom) of the guide bar rail groove 23 is preferably the same as the distance between the center of the elongated aperture 25 and pivot member 17, which is the point of attachment of the pivot member 17, and the outer most edge of the guide bar 19 in a rest or perpendicular position. The rail groove 40 is preferably made out of a strong material such as steel. The gaff 10 advantageously weighs approximately three ounces (3.0 oz.). The gaff 10 is also advantageously of a moderate size. Preferably, the distal or spiked end portion 13 is about one or two inches long and the proximal end or pivot portion 27 is about three to five inches long.

It can now be seen how the present invention operates. The proper way to use a chain saw is to keep the wood being cut as close to the engine as possible for maximum control at full throttle. Using the middle of the cutting bar is unfavorable and cutting with the tip to plunge or to undercut are the worst conditions. With this in mind, the anti-kickback gaff attachment 10 is ready to work semi-automatically when making normal cross grain cuts in objects 29 to be cut such as logs or branches.

The pivot portion of the gaff 10 is attached to a pivot member 17 such that the gaff 10 can swing freely with offset clearance from the guide bar 19 and chain 21. The gaff 10 is mounted so as to pivot above the rail groove 23 on the lower end 19*b* or cutting side of the guide bar 19 to obtain the proper fulcrum point. The pivot member 17 is also mounted in front of the housing 22 to conserve space and to provide a stop for the gaff 10 so that it can hang perpendicular to the cutting surface of the guide bar 19 in a rest position. The gaff portion 13 is mounted 30° off the vertical, facing upward and forward from the pivot member 27 such that the gaff portion can enter the bark or solid wood on a cant angle. The gaff 10 remains in place while the chain saw 20 is cutting. Engagement of the gaff 10 into the wood is determined by the diameter of the wood after the guide bar 19 and the chain 21 make the initial kerf cut. The gaff 10 descends proportionately on the cant angle when relocating.

When cutting large logs, relocation is necessary and easily done by lowering the housing 22 for a new bite into the bark for continued rotation of the guide bar 19 and the chain 21. To engage the gaff 10 into the bark, a light pull upward on a chain saw 20 throttle handle (not shown) is required. The harder the pull, the deeper the penetration. The swivel effect of the pivot member 17 is provided to prevent the gaff 10 from removing itself during rotation of the housing 22 and the guide bar 19. During a cutting operation, it is advisable to keep upward pressure on the throttle handle (not shown) when the gaff 10 is engaged. This makes the guide bar 19 and chain 21 assembly move downward through a cut and ensures that the gaff 10 assembly remains the fulcrum point of the cut.

Advantageously, the outside surface of the gaff 10 is rounded to minimize any friction forces during a cutting operation. The gaff 10 preferably has a rounded contour which tapers off to a needle like point. On the lower or rounded side of the gaff 10, the 30° angle works as a loading ramp for the object 29 to be cut so that the gaff 10 can slide upward toward the point and to relocate the gaff 10 on large cuts. The rounded sides provide less friction. Furthermore, the inside surface of the gaff 10 is preferably substantially flattened to provide an increased holding surface. Flattening the inside surface of the gaff provides maximum holding capacity for a wide variety of shaped objects 29 to be cut. Moreover, the length of the gaff 10 permits it to penetrate many different sized bark thicknesses.

The aperture 25 on the lower end 19*b* of the guide bar 19 has several purposes. First, it is the point of attachment for the pivot member 17 by means of a socket head cap screw assembly 33 and 35. This is critical for maintaining a fulcrum point. The fulcrum point could be lost if the aperture 25 was on the center or upper end 19*a* of the guide bar 19. The aperture 25 is located just above the rail groove 23 that houses the chain drive links 21. Second, the aperture 25, if it is elongated, allows the gaff 10 to slide forward or backward for easy chain replacement and also for adjustment due to normal chain 21 heat stretching. The gaff 10 must stop perpendicular to the guide bar 19 when at rest and the sliding ability helps maintain this condition. The stop against position is needed for gaff 10 penetration into and engagement with the object 29 to be cut.

Preferably, the pivot member 17 is mounted to the guide bar 19 via a bolt assembly. Preferably, the threaded bolt assembly includes means for spacing the combination gaff 10 and the guide bar 19. The gaff 10 is positioned between the head of a cap screw and a steel lock nut 35. The lock nut 35 is tightened just short of making contact with gaff 10 so that the gaff 10 can swing free. A second lock nut 33 is advantageously threaded up to the first lock nut 35. The two nuts 33 and 35 coact as spacers for clearance between the guide bar 19 and gaff 10. Flat washers 37*a* and 37*b* may also be preferably used one on each side of the guide bar 19 with a lock nut 38 on the outboard side of the guide bar 19 to secure the assembly. The spacing can be changed by the addition of additional bolts and/or washers.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. An improved power driven chain saw for controlling kickback of the type having a housing, a motor mounted in said housing, a guide bar having a substantially equal lower end, a rail groove extending circumfentially around said guide bar and a chain situated within said rail groove, wherein the improved chain saw comprises means for controlling kickback, said control means comprising a gaff pivotable mounted on said chain saw, said gaff having a distal end portion and a proximal end portion, said distal end portion being in a form of a spike or a hook which penetrates and engages an object to be cut and said distal end portion being positioned at an angle to said proximal end portion, said proximal end portion extending longitudinally and having means for pivotally mounting said gaff on said chain saw said proximal end portion of said gaff having a hole for mounting on a pivot member on said guide bar and that said gaff freely swings about said pivot member, said pivot member comprising a rod having one end attached to said lower end of said guide bar and being positioned above said rail groove on an inward and frontal side of said housing, and said gaff is mounted at an acute angle to said pivot member such that said distal end portion faces forward and upward of said pivot member, whereby said gaff engages said object to be cut and remains therein while said housing and said guide bar are pivoting during a cutting operation.

2. The improved chain saw according to claim 1, wherein said lower end of said guide bar has an elongated hole for accepting said rod and said rod is slidable along said elongated hole.

3. The improved chain saw according to claim 2, wherein the distance between the spike or hook of said gaff to the bottom edge of said guide bar rail groove is the same as the distance between the linear center of said hole to the bottom edge of said guide bar rail groove.

4. The improved chain saw according to claim 1, wherein said gaff includes an inside flat surface and a rounded outside surface.

5. The improved chain saw according to claim 1, further comprising means for adjusting a spacing between said gaff and said housing.

6. The improved chain saw according to claim 5, wherein said space adjusting means comprises a set screw mounted on said proximal end portion of said gaff.

7. The improved chain saw according to claim 1, including a stop means for maintaining said proximal end portion in a position for engaging said object.

8. The improved chain saw according to claim 7, wherein said stop means comprises said housing.

9. An improved power driven chain saw for controlling kickback of the type having a housing, a motor mounted in said housing, a guide bar having a substantially equal lower end, a rail groove extending circumfentially around said guide bar and a chain situated within said rail groove, wherein the improved chain saw comprises means for controlling kickback, said control means comprising a gaff pivotable mounted on said chain saw, said gaff having a distal end portion and a proximal end portion, said distal end portion being in a form of a spike or a hook which penetrates and engages an object to be cut and said distal end portion being positioned at an acute angle to said proximal end portion, said proximal end portion extending longitudinally and having means for pivotally mounting said gaff on said chain saw whereby said gaff engages said object to be cut and remains therein while said housing and said guide bar are pivoting during a cutting operation.

10. The improved chain saw according to claim 9, wherein said acute angle between said distal and proximal end portions comprises about 30°.

* * * * *